US006457591B1

(12) United States Patent
Lee

(10) Patent No.: US 6,457,591 B1
(45) Date of Patent: Oct. 1, 2002

(54) MULTI-FUNCTIONAL DISPLAY RACK

(76) Inventor: Funder Lee, P.O. Box 82-144, Taipei (TW)

( * ) Notice: Subject to any disclaimer, the term of this patent is extended or adjusted under 35 U.S.C. 154(b) by 0 days.

(21) Appl. No.: 09/796,516

(22) Filed: Mar. 2, 2001

(51) Int. Cl.[7] ..... A47G 19/30
(52) U.S. Cl. ..... 211/41.2; 248/447
(58) Field of Search ..... 211/41.2, 94.01; 248/279.1, 292.14, 296.1, 298.1, 291.1, 307, 308, 458, 460, 447; D20/21; D19/90, 91

(56) References Cited

U.S. PATENT DOCUMENTS 3,999,734 A * 12/1976 Gibson et al. ..... 248/460
4,592,471 A * 6/1986 Bross ..... 211/41.2
5,042,771 A * 8/1991 Demarest, Jr. ..... 248/458
5,607,135 A * 3/1997 Yamada ..... 248/447

* cited by examiner

*Primary Examiner*—Daniel P. Stodola
*Assistant Examiner*—Erica B. Harris
(74) *Attorney, Agent, or Firm*—Leong C. Lei

(57) ABSTRACT

A multi-function display rack includes a base having four corners provided with four an upwardly extending stop blocks. A slot is formed between two adjacent stop blocks and a rectangular opening is formed at an intermediate portion of the base. The rack further includes a slider having two shoulders at two opposites sides thereof and a through hole, having a larger diameter at a lower portion thereof, formed at a central portion thereof. The slider being fitted in the rectangular opening with the shoulders bearing against the bottom side of the base thereby enabling the slider to move along the rectangular opening. The rack also includes a rotatable seat having a downwardly extending tubular portion having a flange at a lower end thereof and a through hole extending through a center of the tublar portion, the rotatable seat being mounted on the base with the tublar portion extending downwardly through the rectangular opening to engage with the through hole of the slider with the flange engaged with the larger diameter of the slider thus enabling the rotatable seat to be rotated with respect to the base. A supporting member is provided with two legs each having a rib at a back side thereof and an inwardly extending protuberance at a lower end thereof, the inwardly extending protuberance being pivotally connected with the slider.

3 Claims, 7 Drawing Sheets

MULTI-FUNCTIONAL DISPLAY RACK

BACKGROUND OF THE INVENTION (a) Field of the Invention

This invention is related to a multi-functional display rack and in particular to one that is extremely stable, adjustable and retractable to fit objects of different sizes and proportions for display purposes.

(b) Description of the Prior Art

The conventional displaying rack is fixed in size and cannot be adapted to receive various kinds of objects. So, it is necessary to prepare a number of various kinds of displaying racks for various kinds of displaying objects. Furthermore, the conventional kind of displaying rack is generally triangular in shape, is not retractable, and cannot stand firmly on the table. It will fall down easily and break.

Therefore, it is an object of the present invention to provide a multi-functional display rack which can obviate and mitigate the above-mentioned drawbacks.

SUMMARY OF THE INVENTION

This invention is related to a multi-functional display rack.

It is the primary object of the present invention to provide a multi-functional display rack that is extremely stable, adjustable and retractable to fit objects of different sizes and proportions for display purposes.

It is another object of the present invention to provide a multi-functional display rack that can be adjusted to keep an object at either side thereof.

It is a further object of the present invention to provide a multi-functional display rack that can show the title, specification and the price of a displayed object.

According to a preferred embodiment of the present invention, a multi-functional display rack includes a base having four comers provided with four an upwardly extending stop blocks. A slot us formed between two adjacent stop blocks and a rectangular opening is formed at an intermediate portion of the base.

The rack further includes a slider having two shoulders at two opposites sides thereof and a through hole, having a larger diameter at a lower portion thereof, formed at a central portion thereof The slider being fitted in the rectangular opening with the shoulders bearing against the bottom side of the base, thereby enabling the slider to move along the rectangular opening. The rack also includes a rotatable seat having a downwardly extending tubular portion having a flange at a lower end thereof and a through hole extending through a center of the tubular portion, the rotatable seat being mounted on the base with the tubular portion extending downwardly through the rectangular opening to engage with the through hole of the slider with the flange engaged with the larger diameter of the slider thus enabling the rotatable seat to be rotated with respect to the base. A supporting member is provided with two legs, each having a rib at a back side thereof and an inwardly extending protuberance at a lower end thereof, the inwardly extending protuberance being pivotally connected with the slider.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
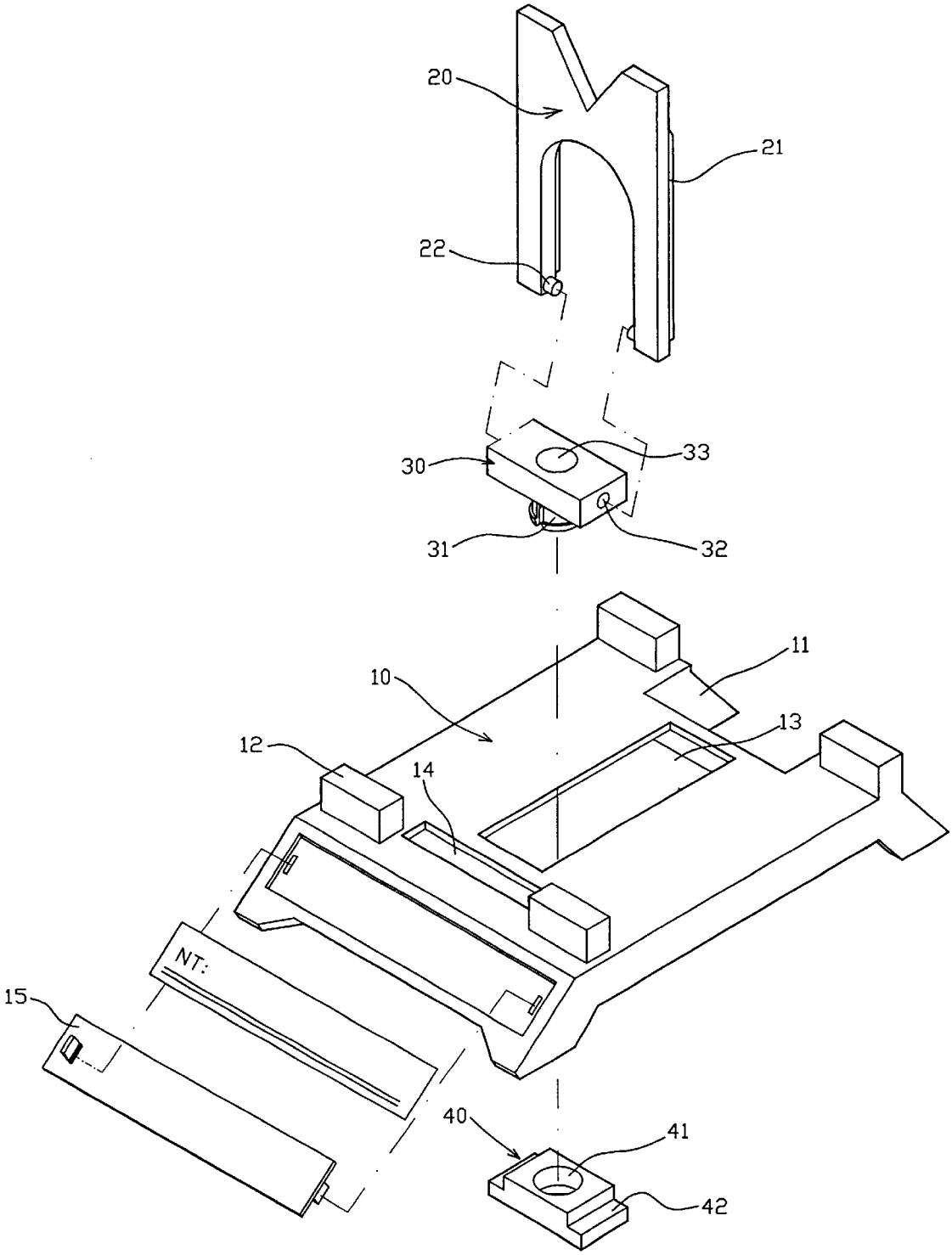
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and fewer modifications in the illustrated device, and further applications of the principles of the invention as illustrated herein being contemplated as would normally occur to one skilled in the art to which the invention relates.

Figure 2:
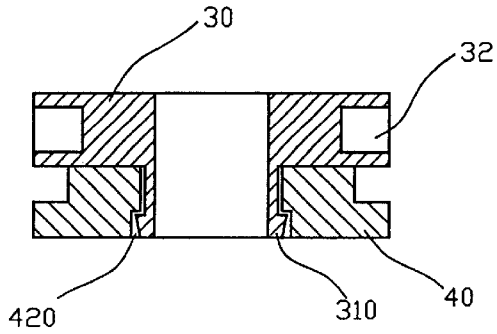
FIG. 2 is a sectional view illustrating the engagement between the rotatable seat and the slider.
Figure 3:
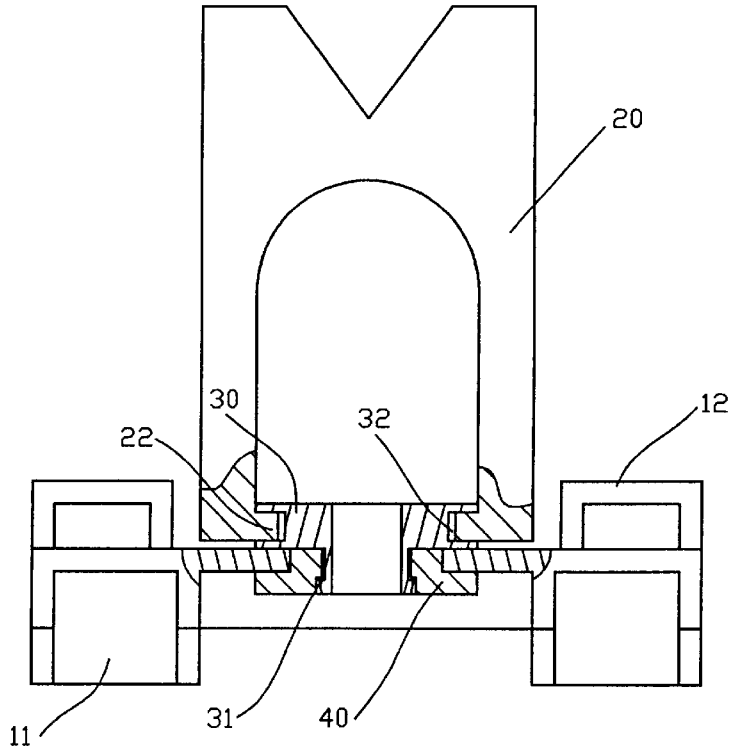
FIG. 3 is a sectional view of the present invention.

With reference to the drawings and in particular to FIGS. 1, 2 and 3 thereof, the multi-functional display rack according to the present invention generally comprises a base 10, a slider 40, a rotatable seat 30 and a supporting member 20.

The base 10 is an integral member formed by injection molding and provided with four legs 11 at four lower comers thereof so that the base 10 can stand firmly on a table. The four upper comers of the base 10 are each provided with a stop block 12. A slot 14 is formed on the base 10 between two front stop blocks 12 for receiving the lower portion of an object to be displayed. A transparent sheet 15 is arranged on the front side of the base 10 for keeping a label for illustrating the name, price, function and the like. A rectangular opening 13 is formed at the intermediate portion of the base 10.

The slider 40 has two shoulders 42 at two sides thereof and a through hole 41 at the central portion thereof The slider 40 is fitted in the rectangular opening 13 with its shoulders 42 bearing against the lower side of the base 13, so that the slider 40 may be moved along the rectangular opening 13. The through hole 41 has a larger diameter 420 at the lower portion.

The rotatable seat 30 is formed at the bottom with a tubular portion 31 having a flange 310 at the lower end and a through hole 33 extending through the center of the tubular portion 31. The rotatable seat 30 is mounted on the base 10 with the tubular portion 31 extending downwardly through the rectangular opening 13 to engage with the through hole 41 of the slider 40, with the flange 310 of the tubular portion 31 engaged with the larger diameter 42 of the slider 40, thereby enabling the rotatable seat 30 to be rotated with respect to the base 10. The rotatable seat 30 is formed with two holes 32 at two opposite ends thereof.

The supporting member 20 is provided with two legs each having a rib 21 at the back side and an inwardly extending protuberance 22 at the lower end.

The supporting member 20 is engaged with the rotatable seat 30, with the protuberances 22 of the former engaged with the holes 32 of the latter. The ribs 21 are used for disposing the supporting member 20 at an inclined position.

Figure 4:
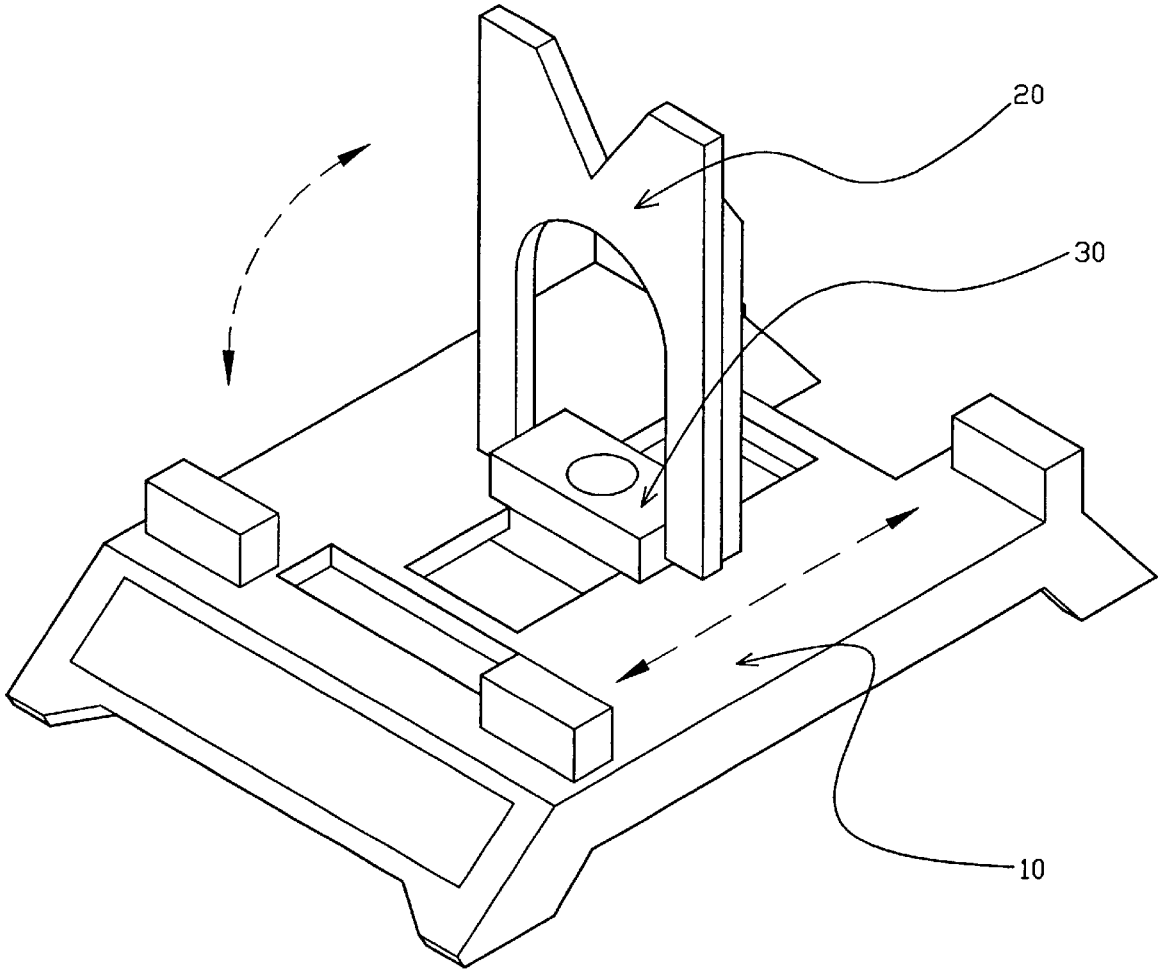
FIG. 4 is a perspective view of the present invention.
Figure 5:
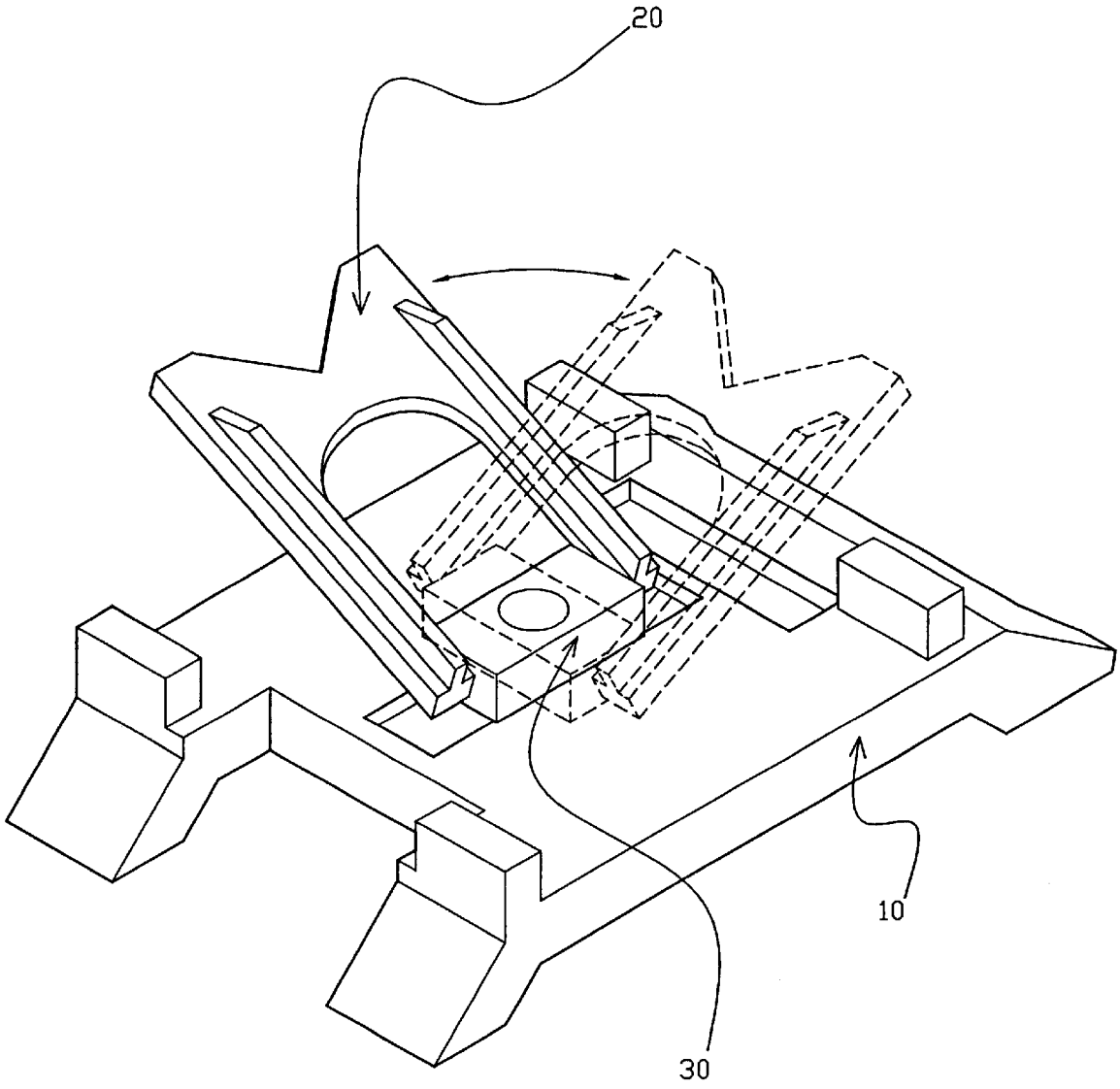
FIG. 5 illustrates how the supporting member is rotated with respect to the base.
Figure 6:
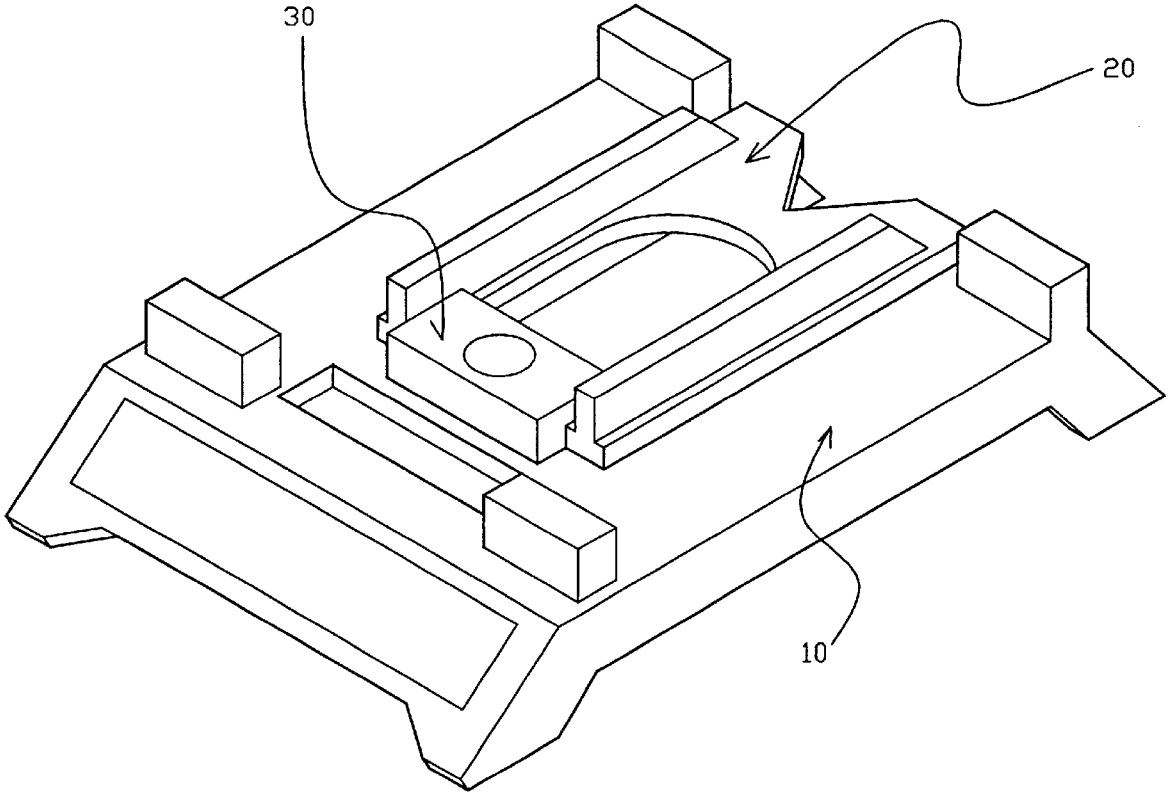
FIG. 6 illustrates how the supporting member is folded on the base.
Figure 7:
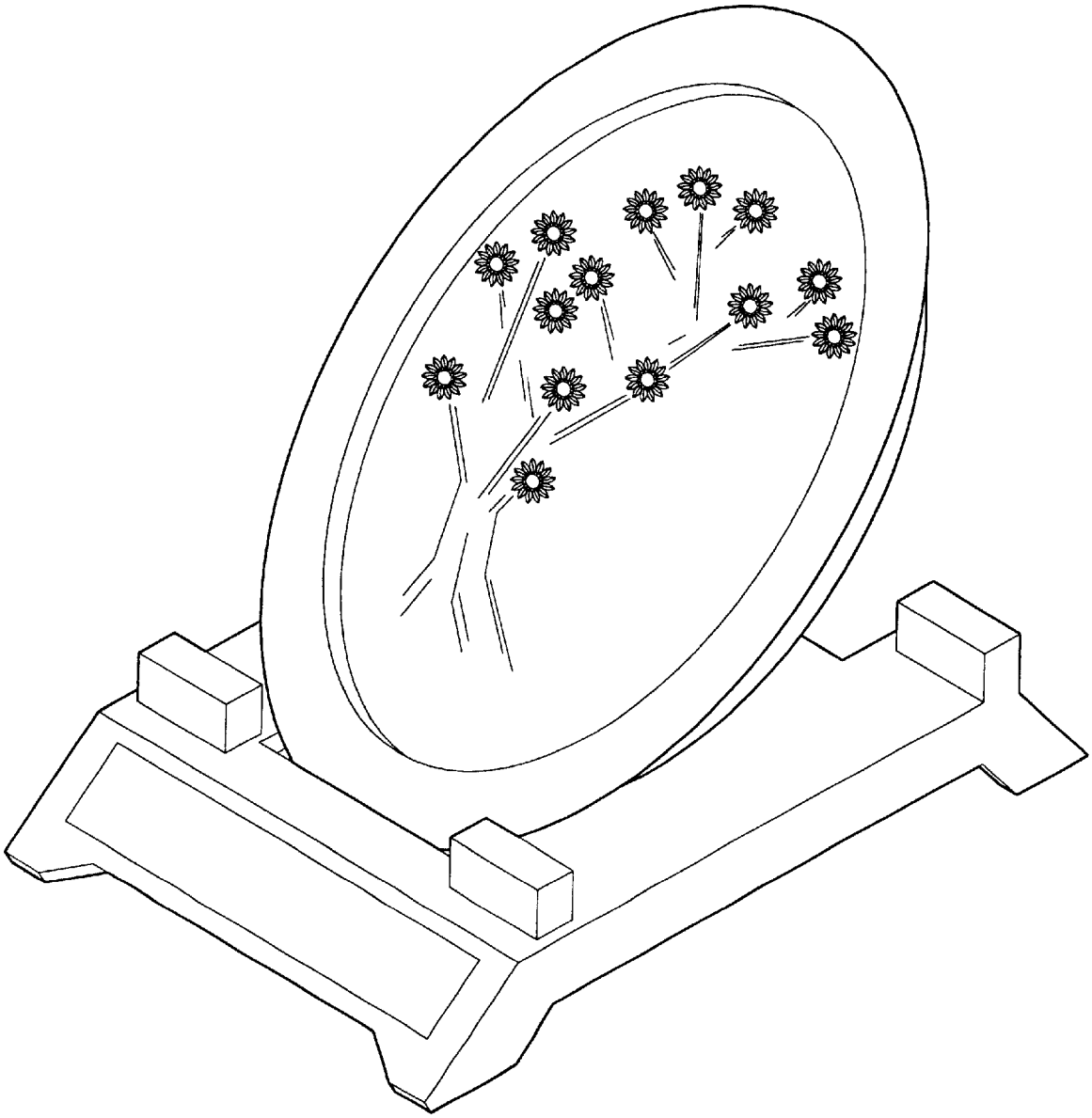
FIGS. 7 and 8 are working views of the present invention.
Figure 8:
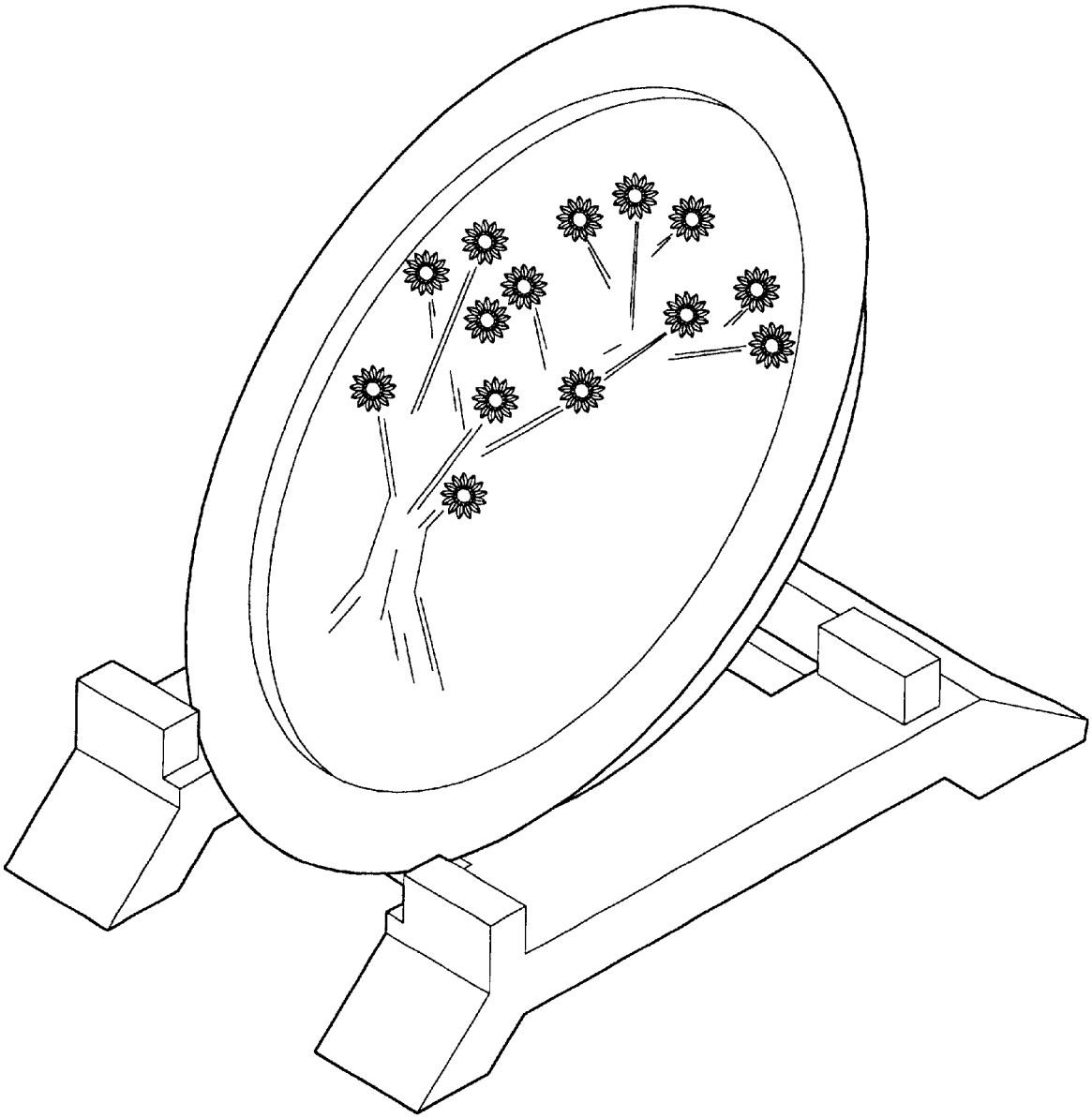

Referring to FIGS. 4 and 5, the rotatable seat 30 may be moved along the rectangular opening 13 and the supporting member 20 may be rotated through an angle of 360 degrees with respect to the base 10. As shown in FIG. 6, the supporting member 20 may be folded on the base 10 when not in use thereby facilitating the stowage and transportation thereof. As illustrated in FIGS. 7 and 8, an object may be disposed at either side of the base 10 as desired.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-functional display rack comprising:

a base having four comers provided with four upwardly extending stop blocks, a slot formed between two adjacent stop blocks, and a rectangular opening formed at an intermediate portion of said base;

a slider having two shoulders at two opposite sides thereof and a through hole at a central portion thereof, said slider being fitted in said rectangular opening with said shoulders bearing against a bottom side of said base thereby enabling said slider to move along said rectangular opening, said through hole having a larger diameter at a lower portion thereof;

a rotatable seat having a downwardly extending tubular portion having a flange at a lower end thereof and a through hole extending through a center of said tubular portion, said rotatable seat being mounted on said base with said tubular portion extending downwardly through said rectangular opening to engage with said through hole of said slider with said flange engaged with said larger diameter of said slider thus enabling said rotatable seat to be rotated with respect to said base; and a supporting member provided with two legs, each having a rib at a back side thereof and an inwardly extending protuberance at a lower end thereof, said inwardly extending protuberance being pivotally connected with said rotatable seat.

2. The multi-functional display rack as claimed in claim 1, wherein a transparent sheet is arranged on a front side of said base.

3. The multi-functional display rack as claimed in claim 1, wherein said base is provided with four supporting legs.

* * * * *